US009038411B2

(12) United States Patent
Matsumoto

(10) Patent No.: US 9,038,411 B2
(45) Date of Patent: May 26, 2015

(54) BLOCK ICE MAKER WITH MOLD BODY AND METHOD OF FORMING FAN SHAPED ICE WITH MOLD BODY

(71) Applicants: Soichiro Inamori, Tokyo (JP); Reijiro Inamori, Tokyo (JP)

(72) Inventor: Tadao Matsumoto, Nagoya (JP)

(73) Assignees: Soichiro Inamori, Tokyo (JP); Reijiro Inamori, Tokyo (JP)

( * ) Notice: Subject to any disclaimer, the term of this patent is extended or adjusted under 35 U.S.C. 154(b) by 0 days.

(21) Appl. No.: 14/172,093

(22) Filed: Feb. 4, 2014

(65) Prior Publication Data

US 2014/0216072 A1 Aug. 7, 2014

(30) Foreign Application Priority Data

Feb. 7, 2013 (JP) ..... 2013-021983

(51) Int. Cl.
*F25C 1/04* (2006.01)
*F25C 1/12* (2006.01)
*F25C 1/22* (2006.01)

(52) U.S. Cl.
CPC ... *F25C 1/04* (2013.01); *F25C 1/12* (2013.01); *F25C 1/22* (2013.01)

(58) Field of Classification Search
CPC ..... F25C 1/22; F25C 1/24; A23G 9/12; A23G 9/083; A23G 9/221
USPC ..... 62/342, 68, 75, 345, 356, 353
See application file for complete search history.

(56) References Cited

U.S. PATENT DOCUMENTS 8,528,356 B2 * 9/2013 Junge et al. ..... 62/320

FOREIGN PATENT DOCUMENTS

JP 2011-112279 A 6/2011

* cited by examiner

*Primary Examiner* — Cassey D Bauer
(74) *Attorney, Agent, or Firm* — Norris McLaughlin & Marcus P.A.

(57) ABSTRACT

An ice maker has an ice-making vessel having a cylindrical shape, a cooling means, a block ice making mold which is placed inside, and an agitator. The mold includes a main mold body having a plurality of connected L-shaped plates projected radially outward from the central axis; a base plate which is joined to each L-shaped plate, and the top side of the L-shaped plates form a screw insertion part of the mold body such that the agitator fits between the L-shaped plates at a second end of the central axis.

5 Claims, 4 Drawing Sheets

(A)

(B)

(C)

BLOCK ICE MAKER WITH MOLD BODY AND METHOD OF FORMING FAN SHAPED ICE WITH MOLD BODY

BACKGROUND

1. Technical Field

The present invention relates to an ice maker, more particularly to an ice maker which manufactures block ice or small molded ice.

2. Related Art

Ice that has been distributed in the market is mainly prism-shaped, large-sized ice manufactured in an ice can. The ice can is used to manufacture the ice industrially on a large scale by a method described in JP 2011-112279 A, for example.

A consumer of ice is diverse including a general household, a general restaurant, a bar, a fishing gear shop, and a store which is particular about ice. In general, these consumers either purchase the prism-shaped, large-sized ice manufactured in the ice can and cut up into a convenient size or manufacture ice on a small scale in a household refrigerator. As described above, there is no ice maker exclusively used to make ice on a relatively small scale that is currently sold on the market as far as the inventor is aware.

SUMMARY

The present invention has been made in consideration of the aforementioned circumstances. An object of the present invention is to provide an ice maker that is small, has no restriction on the place of use, and can easily manufacture a certain amount of ice in a relatively short period of time.

The inventors have conducted various studies to attain the aforementioned object and adopted the following means as a result.

First, an ice-making vessel that has a cylindrical shape with a closed bottom is adopted. In general, ice undergoes volume expansion when formed, at which time it is difficult to take the ice out of an ice-making vessel. However, the formed ice is easily taken out of the ice-making vessel when the cylindrical ice-making vessel is adopted as compared to a square ice-making vessel.

Secondly, it is devised to manufacture ice while an ice making mold having a predetermined structure is inserted in the ice-making vessel. The ice making mold is inserted to be able to manufacture relatively large-sized block ice, which can then be easily taken out of the ice-making vessel.

Thirdly, it is devised to further attach a separation shelf to the block ice making mold. A number of pieces of molded ice smaller than the block ice can be manufactured at once by using the separation shelf, and the ice can be easily taken out of the ice-making vessel at the same time.

Fourthly, it is devised to provide a screw type agitator inside the ice-making vessel. The ice maker in the related art employs a method of preventing a cloudy strip formed in the ice by blowing air into water to be made into ice but not yet frozen during the manufacture of the ice. However, this method employing the blowing of the air causes fine dust contained in the air to be blown into the water to be made into ice, thereby contaminating the ice being obtained. The ice being obtained is not contaminated with dust in the present invention where the screw type agitator is used to agitate the water to be made into ice.

The present invention has been completed as a result of the aforementioned considerations.

Accordingly, the present invention provided to solve the aforementioned problem is described as follows.

[1] An ice maker comprising:
- an ice maker main body comprising:
  - an ice-making vessel having a cylindrical shape with a closed bottom; and
  - cooling means which cools the interior of the ice-making vessel from outside;
- a block ice making mold which is placed inside the ice-making vessel; and
- a screw type agitator, a screw side of which is inserted into the ice-making vessel along a central axis of the ice-making vessel, wherein
- the block ice making mold includes:
  - a main mold body which is formed of a plurality of L-shaped plates connected to each other along one side of each of the L-shaped plates serving as a central axis, the each L-shaped plate being projected radially outward from the central axis; and
  - a base plate which is joined to the each L-shaped plate at one end of the central axis, and
- the main mold body includes a screw insertion part which is formed by cutting off another end side of the central axis by a predetermined length along a side of the central axis from the another end side toward the one end side of the central axis.

[2] The ice maker according to [1], wherein
- the block ice making mold is formed by including a separation shelf inserted between mutually adjoining L-shaped plates, and
- the separation shelf includes a plurality of fan-shaped horizontal plates arranged at predetermined intervals and a rectangular vertical plate arranged at a predetermined interval, the horizontal and vertical plates together forming a lattice shape.

[3] The ice maker according to [1] or [2], wherein the ice-making vessel includes heating means along an outer periphery of the ice-making vessel.

[4] A method of manufacturing fan-shaped molded ice, the method using the ice maker according to [2], wherein the molded ice has a predetermined thickness and becomes wider from one end side toward another end side.

[5] A method of manufacturing fan-shaped molded ice, the method including:
- manufacturing ice by using the ice maker according to [2];
- taking out a block ice making mold from an ice-making vessel;
- taking out a separation shelf from the block ice making mold; and
- separating the fan-shaped molded ice from the separation shelf by bending the separation shelf being taken out.

The ice maker includes the ice-making vessel that has the cylindrical shape with the closed bottom, whereby the ice being manufactured can be easily taken out of the ice-making vessel.

The ice maker manufactures ice while the ice making mold is inserted, whereby the block ice having the predetermined shape can be manufactured. The block ice is easily taken out by taking the ice making mold out of the ice-making vessel.

The separation shelf can be further attached in the block ice making mold in the ice maker, whereby a number of pieces of molded ice smaller than the block ice can be manufactured at once by using the separation shelf and, at the same time, the ice is easily taken out of the ice-making vessel. Moreover, the ice maker is easy to use in that one needs to simply bend the separation shelf by a hand in taking out the molded ice from the separation shelf.

The air blowing is not performed according to the ice maker in order to keep the transparency of the ice. As a result, the ice being obtained has less dust contained in the air.

DETAILED DESCRIPTION

An embodiment of the present invention will now be described in detail with reference to the drawings.

Figure 1:
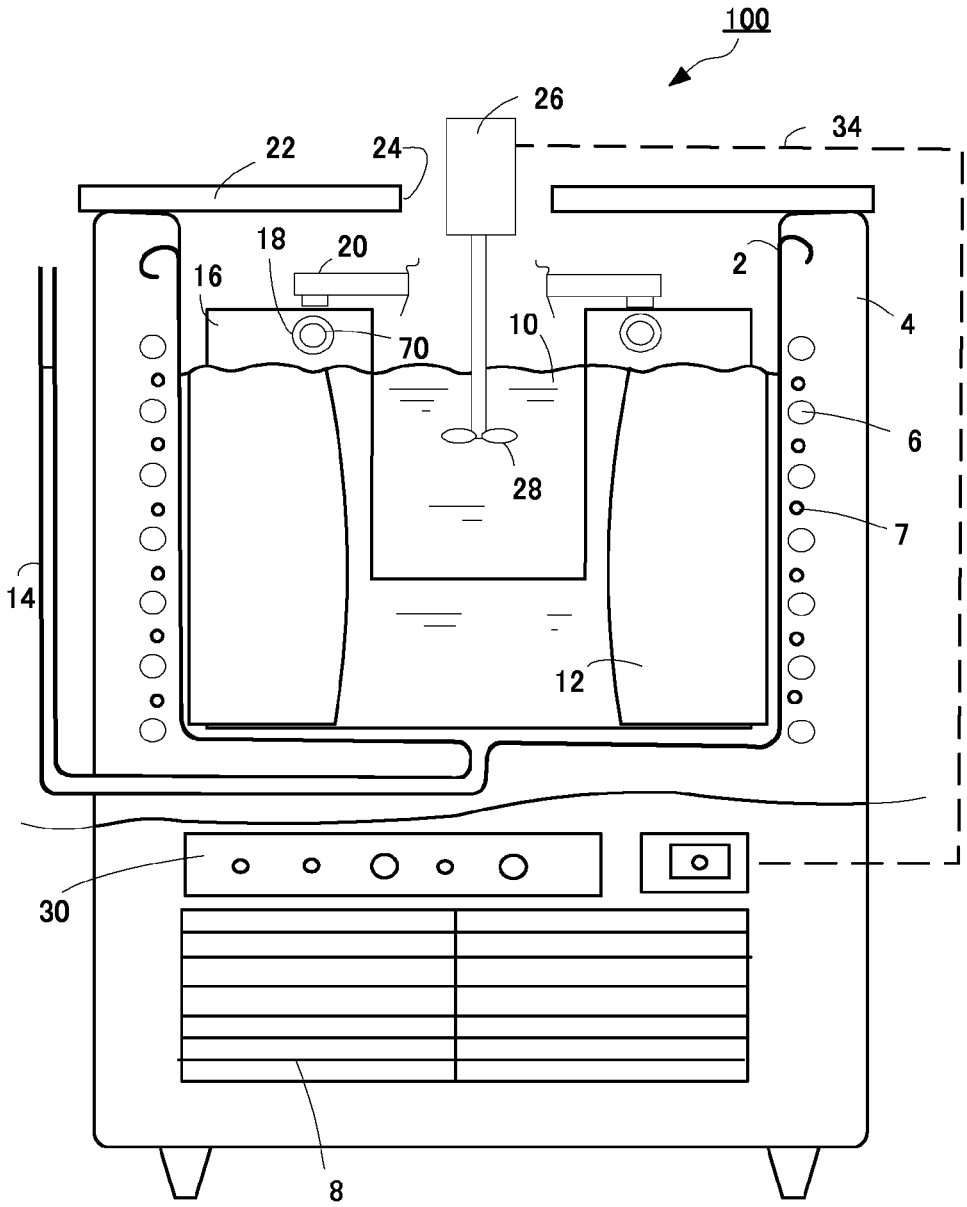
FIG. 1 is a front view illustrating an example of an ice maker according to the present invention.

An ice maker 100 illustrated in FIG. 1 is an example of the present invention. An ice-making vessel 2 has a cylindrical shape with a closed bottom and is formed of stainless steel or synthetic resin, for example. The outer periphery of the ice-making vessel is covered by a heat insulating material 4. A cooling pipe 6 is embedded along the outer periphery of the ice-making vessel 2 inside the heat insulating material 4 so that a refrigerant supplied from a refrigerating unit 8 as cooling means passes through the cooling pipe 6 to cool the ice-making vessel 2 and transform water 10 stored in the ice-making vessel into block ice 12. Calcium chloride solution or the like is used as the refrigerant, as is well known.

Moreover, heating means 7 such as a cord heater is embedded along the outer periphery of the ice-making vessel 2 in the heat insulating material 4. An operation performed on an operation panel 30 automatically supplies power to the heating means 7 after the ice is manufactured and before taking out the block ice 12 from the ice-making vessel 2. As a result, the block ice 12 in contact with the inner surface of the ice-making vessel 2 is melted to some extent, thereby making it easier to take out the block ice 12 from the ice-making vessel 2. Note that the refrigerant supply is discontinued before the power is supplied to the heating means 7.

An end of a drain pipe 14 is connected to the bottom wall of the ice-making vessel 2. The drainpipe is used when draining the water 10 in the ice-making vessel 2.

A locking hole 18 is punched in the upper part of a block ice making mold 16, and a handle 20 to be described later is hooked by the locking hole. One places a hand on the handle 20 and pull the handle upward to remove, from the ice-making vessel 2, the block ice making mold 16 as well as the block ice 12 manufactured while adhering thereto.

A cover plate 22 is placed on the ice-making vessel 2, and an agitating screw insertion hole 24 is punched through the center of the cover plate. An agitating screw 28 of an agitator 26 is inserted through the insertion hole 24 into the water 10 stored in the ice-making vessel 2.

An operation on the operation panel 30 supplies power to a power line 34 and the agitator 26 in order to control the rotating speed of the screw 28.

FIG. 2A is an enlarged perspective view, FIG. 2B is a plan view, and FIG. 2C is a side view each illustrating an example of the block ice making mold 16 for inserting in the ice-making vessel.

FIGS. 2A to 2C illustrate the block ice making mold 16. A main mold body 41 has a plurality of L-shaped plates (four pieces of L-shaped plates 42*a*, 42*b*, 42*c*, and 42*d* in FIG. 2A), each of which is formed by cutting a corner of a rectangular plate off in an oblong shape. The L-shaped plates are connected to each other along one side of each of the plates serving as a central axis 44. Accordingly, another side 46 of each of the L-shaped plates 42*a*, 42*b*, 42*c*, and 42*d* facing the one side is projected radially outward from the central axis 44.

A screw insertion part 50 is provided at one end side 52 of the central axis 44 and is formed of the cut-off part of the plurality of L-shaped plates 42*a*, 42*b*, 42*c*, and 42*d*. Each of the L-shaped plates 42*a*, 42*b*, 42*c*, and 42*d* of the main mold body 41 is joined to a base plate 56 at another end 54 of the central axis 44.

A drain hole 58 is punched in the base plate 56 at the another end 54 of the central axis 44.

A handle locking hole 18 is formed at the one end side of the L-shaped plates 42*a* and 42*c* facing each other. A handle locking recess 62 is further provided.

Figure 3:
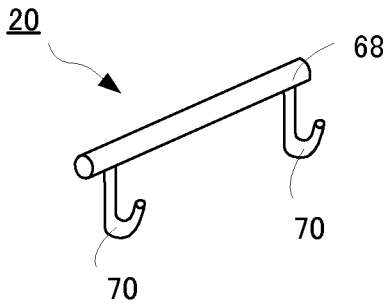
FIG. 3 is a perspective view illustrating an example of a handle used in the present invention.

FIG. 3 is a perspective view illustrating the handle 20. The handle 20 is formed of a rodlike grip part 68 and a locking hook 70 attached on each of both end sides of the grip part 68. The locking hook 70 of the handle 20 is locked in the handle locking hole 18 of the L-shaped plates 42*a* and 42*c* while the grip part 68 of the handle is engaged in the handle locking recess 62 formed in the L-shaped plate 42*b*, at the time of manufacturing ice.

Figure 4:
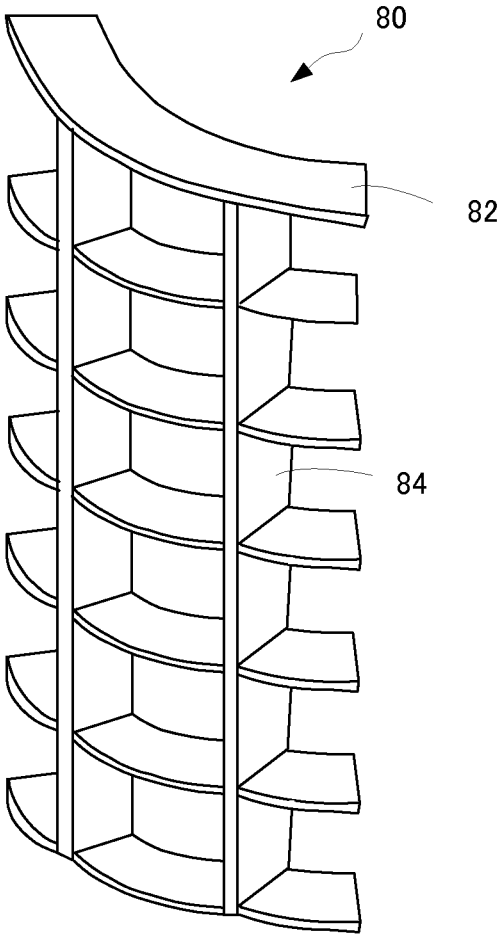
FIG. 4 is a perspective view illustrating an example of a separation shelf used in the present invention.

FIG. 4 is a perspective view illustrating an example of the separation shelf 80. The separation shelf 80 includes a plurality of (seven pieces in this example) fan-shaped horizontal plates 82 arranged in parallel at predetermined intervals and a plurality of (two pieces in this example) rectangular vertical plates 84 arranged in parallel at predetermined intervals, where the horizontal and vertical plates together form a lattice shape.

Figure 2:
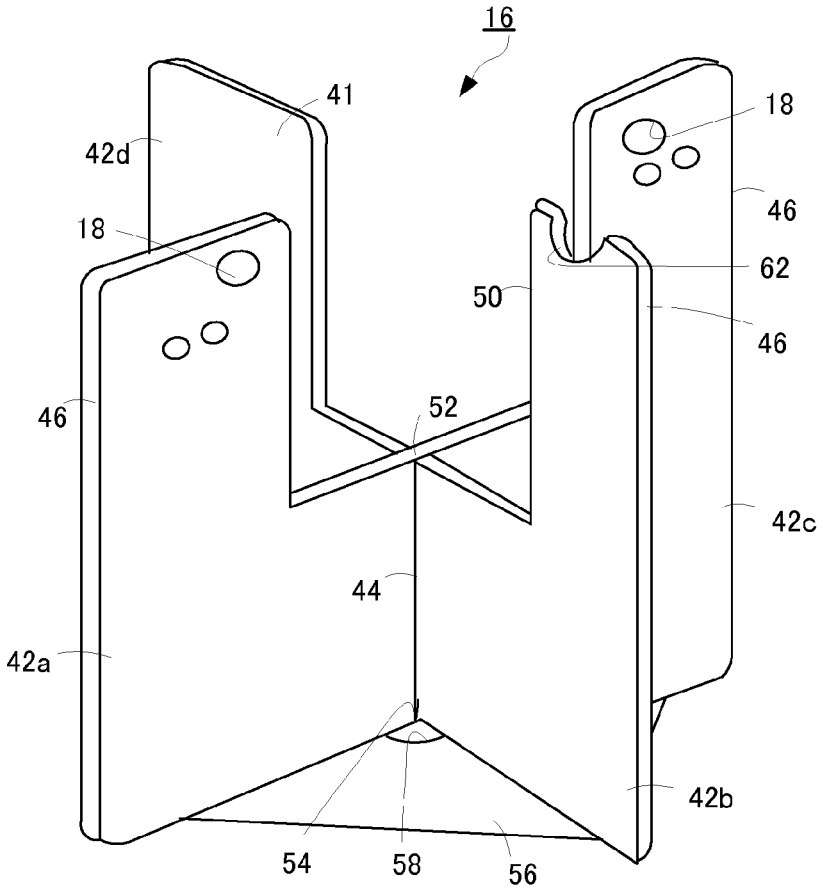
FIG. 2A is an enlarged perspective view.
FIG. 2B is a plan view.
FIG. 2C is a side view each illustrating an example of a block ice making mold used in the present invention.
Figure 2:
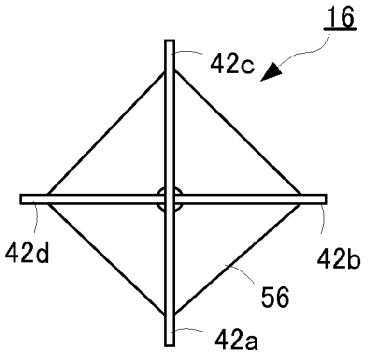
Figure 2:
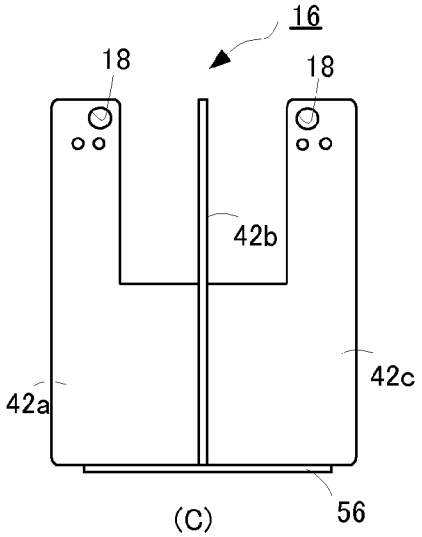
Figure 5:
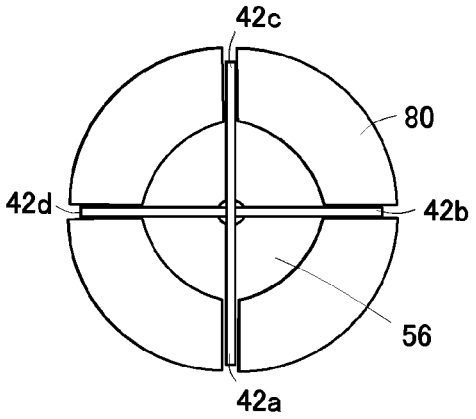
FIG. 5 is a plan view illustrating a state where the separation shelf is placed on the block ice making mold.

The separation shelf 80 is placed among the two adjoining L-shaped plates (such as the plates 42*a* and 42*b*) and the base plate 56 of the block ice making mold 16 illustrated in FIG. 2, 2, and is used in manufacturing molded ice to be described later. The maximum of four separation shelves 80 can be placed in the block ice making mold 16 illustrated in FIG. 2, for example. FIG. 5 is a plan view illustrating the case where the four separation shelves 80 are placed in the block ice making mold 16.

Next, there will be described the manufacture of ice using the ice maker according to the aforementioned embodiment.

(Manufacture of block ice)

First, the block ice making mold 16 is placed inside the ice-making vessel 2 of the ice maker 100 illustrated in FIG. 1. Water is then poured into the ice-making vessel 2. Next, the ice-making vessel 2 is covered with the cover plate 22 so that the agitating screw 28 of the agitator 26 is inserted through the insertion hole 24 of the cover plate 22 into the water 10 stored in the ice-making vessel 2. The agitating screw 28 is rotated in response to an operation performed on the operation panel 30, followed by the cooling of the ice-making vessel 2 by the refrigerant supplied from the refrigerating unit 8 and passing through the cooling pipe 6, thereby transforming the water 10 stored in the vessel into the block ice 12.

The water 10 gradually freezes from near the inner wall of the ice-making vessel 2 toward the center thereof as time elapses, while the block ice 12 continues to grow. Once the block ice 12 is formed to have a predetermined thickness, the agitator 26 and the cover plate 22 are removed. One then places a hand on the handle 20 and pull the handle upward to remove, from the ice-making vessel 2, the block ice making mold 16 as well as the block ice 12 manufactured while adhering thereto. Note that the ice near the inner periphery of the ice-making vessel 2 melts to some extent after awhile upon completing the manufacture of the ice, at which point the block ice making mold is more easily removed.

Figure 6:
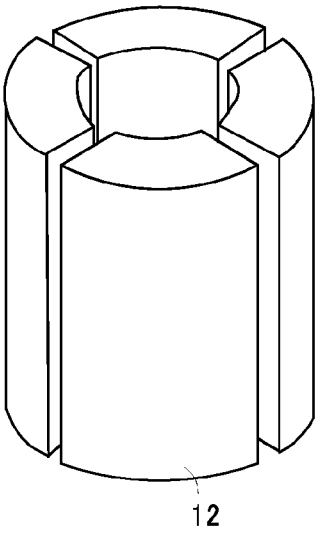
FIG. 6 is a perspective view illustrating an example of block ice manufactured by the ice maker.

After that, the block ice 12 illustrated in FIG. 6 is obtained by taking out the block ice 12 from the block ice making mold 16.

(Manufacture of molded ice)

Molded ice is manufactured in a manner similar to the manufacture of the block ice other than the use of the ice making mold 16 on which the separation shelf 80 is placed as illustrated in FIG. 5 instead of using the ice making mold 16 alone. The block ice making mold 16 is then removed from the ice-making vessel 2, and the separation shelf 80 filled with the molded ice is separated from the block ice making mold 16. After that, one holds both ends of the separation shelf 80 by hands and twists and bends the separation shelf 80, whereby the molded ice is easily separated from the separation shelf 80.

Figure 7:
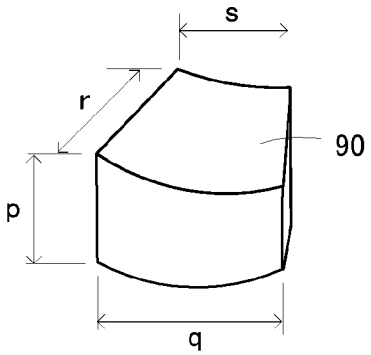
FIG. 7 is a perspective view illustrating an example of molded ice manufactured by the ice maker.

FIG. 7 illustrates an example of molded ice 90 being obtained. The ice has a fixed thickness and has a fan shape which narrows from a wide end side toward another end side.

The dimension of the molded ice 90 includes, for example, the thickness equal to p=40 mm, the width on the wide side equal to q=60 mm, the length equal to r=50 mm, and the width on the narrow side equal to S=50 mm.

While the block ice making mold is formed of the four L-shaped plates in the aforementioned embodiment, the block ice making mold can be formed of two or more, preferably anywhere between three to ten L-shaped plates.

Moreover, the number of each of the fan-shaped horizontal plates and the rectangular vertical plates of the separation shelf can be selected at will.

100 ice maker
2 ice-making vessel
4 heat insulating material
6 cooling pipe
7 heating means
8 refrigerating unit
10 water
12 block ice
14 drain pipe
16 block ice making mold
18 locking hole
20 handle
22 cover plate
24 agitating screw insertion hole
26 agitator
28 agitating screw
30 operation panel
34 power line
41 main mold body
42*a, b, c, d* L-shaped plate
44 central axis
46 another side
50 screw insertion part
52 one end side
54 another end
56 base plate
58 drain hole
62 handle locking recess
68 grip part
70 locking hook
80 separation shelf
82 fan-shaped horizontal plate
84 rectangular vertical plate
90 molded ice

What is claimed is:

1. An ice maker comprising:
an ice maker main body comprising:
an ice-making vessel having a cylindrical shape with a closed bottom; and
cooling means which cools the interior of the ice-making vessel from outside;
a block ice making mold which is placed inside the ice-making vessel; and
an agitator, an agitating screw side of which is inserted into the ice-making vessel along a central axis of the ice-making vessel, wherein
the block ice making mold includes:
a main mold body which is formed of a plurality of L-shaped plates connected to each other along one side of each of the L-shaped plates serving as a central axis, the each L-shaped plate being projected radially outward from the central axis; and
a base plate which is joined to the each L-shaped plate at one end of the central axis, and
the top side of said L-shaped plates forming a screw insertion part in the mold body such that said agitator fits between the L-shaped plates at a second end of the central axis.

2. The ice maker according to claim 1, wherein
the block ice making mold is formed by including a separation shelf inserted between mutually adjoining L-shaped plates, and
the separation shelf includes a plurality of fan-shaped horizontal plates arranged at predetermined intervals and a rectangular vertical plate arranged at a predetermined interval, the horizontal and vertical plates together forming a lattice shape.

3. The ice maker according to claim 1, wherein the ice-making vessel includes heating means along an outer periphery of the ice-making vessel.

4. A method of manufacturing fan-shaped molded ice, the method using the ice maker according to claim 2, wherein
the molded ice has a predetermined thickness and becomes wider from one end side toward another end side.

5. A method of manufacturing fan-shaped molded ice, the method comprising:
manufacturing ice by using the ice maker according to claim 2;
taking out a block ice making mold from an ice-making vessel;
taking out a separation shelf from the block ice making mold; and
separating the fan-shaped molded ice from the separation shelf by bending the separation shelf being taken out.

* * * * *